US005284334A

United States Patent [19]

Yamamoto

[11] Patent Number: 5,284,334

[45] Date of Patent: Feb. 8, 1994

[54] SHEET FEEDING DEVICE

[75] Inventor: Junich Yamamoto, Hadano, Japan

[73] Assignee: Minolta Camera Kabushiki Kaisha, Osaka, Japan

[21] Appl. No.: 39,646

[22] Filed: Mar. 30, 1993

[30] Foreign Application Priority Data

Apr. 1, 1992 [JP] Japan ..... 4-79635
Jan. 7, 1993 [JP] Japan ..... 5-1300

[51] Int. Cl.[5] ..... B65H 3/08

[52] U.S. Cl. ..... 271/107; 271/90; 271/145; 294/64.1; 414/797

[58] Field of Search ..... 294/64.1; 414/797; 355/312; 271/90, 91, 92, 107, 145

[56] References Cited

U.S. PATENT DOCUMENTS 5,064,183 11/1991 Nishigaki et al. ..... 271/10
5,181,707 1/1993 Takei et al. ..... 271/91

FOREIGN PATENT DOCUMENTS 55-123825 9/1980 Japan ..... 271/90
63-8136 1/1988 Japan .
3-147640 6/1991 Japan ..... 271/107

*Primary Examiner*—H. Grant Skaggs
*Attorney, Agent, or Firm*—Willian Brinks Hofer Gilson & Lione

[57] ABSTRACT

A sheet feeding device for picking up and feeding sheets accommodated in an accommodating portion by movable suction disks. The accommodating portion has concave portion on the bottom so that the suction disks are inserted thereto and retracted therefrom, and a cleaning member is arranged within the concave portion to clean the suction disks when no sheet is present in the accommodating portion.

19 Claims, 10 Drawing Sheets

SHEET FEEDING DEVICE

BACKGROUND OF THE INVENTION

1. Field of the Invention

The present invention relates to a sheet feeding device for feeding, supporting, and transporting sheets by means of suction disks.

2. Description of the Related Art

Well known conventional sheet feeding devices used in image forming apparatus and the like generally use suction disks to pick up a single uppermost sheet from a stack containing a plurality of sheets, and transport said sheet to an image forming section. Such sheet feeding devices are advantageous in that they seldom damage the fed sheet, and suppress the generation of paper dust. However, in such sheet feeding devices, there is some paper dust generated from the sheets, as well as dust, dirt, soiling and the like generated in sections other than the sheet feeding device. Such paper dust, dirt and the like adheres to and accumulates on the suction disks of the sheet feeding device, thereby reducing the suction power of the suction disks and eventually rendering them ineffective such that sheets cannot be fed. Accordingly, the suction disks must be cleaned at regular intervals to prevent paper feeding insufficiency.

Generally, the user must be advised beforehand of the necessity of cleaning the suction disks at regular intervals, the user must open the apparatus in accordance with the need for such cleaning and manually clean the suction disks. This cleaning operation is quite a nuisance from the perspective of the user. When the image forming apparatus is a compact printer and the like, or when a photosensitive type sheet is used such that the apparatus must be opened without allowing light to enter into the interior thereof, the apparatus cannot be opened sufficiently so that the cleaning operation is very cramped. Thus, the cleaning operation becomes quite difficult to perform and poses a serious problem.

Alternatively, Japanese Laid-Open Patent Application No. 3-8136 discloses an arrangement whereby a sheet coated by a sticky cleaning material is suctioned by the suction disks so as to be picked up thereby and clean said suction disks, and thus render the manual cleaning operation by an operator unnecessary. However, when material having a high degree of stickiness is used for the cleaning material, the suctioned sheet coated by the sticky material is difficult to separate from the suction disks, which leads to the fear of paper feeding insufficiency. On the other hand, when material having a low degree of stickiness is used for the cleaning material, the suction disks are not adequately cleaned. Furthermore, in such apparatus, when a sheet coated by a cleaning material is loaded in the paper accommodating portion such that the sheet coated by the cleaning material comes into contact with a sheet used for printing, the sheet used for printing may undergo a change of properties and may be damaged so as to cause sheet feeding insufficiency.

SUMMARY OF THE INVENTION

A main object of the present invention is to provide a sheet feeding device capable of simply cleaning the suction disks which pick up the sheets.

Another object of the present invention is to provide a sheet feeding device capable of cleaning the suction disks which pick up the sheets without causing change in properties or damaging the sheets used for printing and without producing sheet feeding insufficiency.

These and other objects of the present invention are accomplished by providing a sheet feeding device comprising:

sheet accommodating means for accommodating sheets;

vertically movable suction disks for suctioning the sheets accommodated by said sheet accommodating means so as to pick up and transport the sheets;

concave portion formed on the bottom of said sheet accommodating means such that said suction disks are inserted into and retracted from said concave portion; and cleaning member arranged within said concave portion such that the surface is lower than the bottom of the sheet accommodating means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
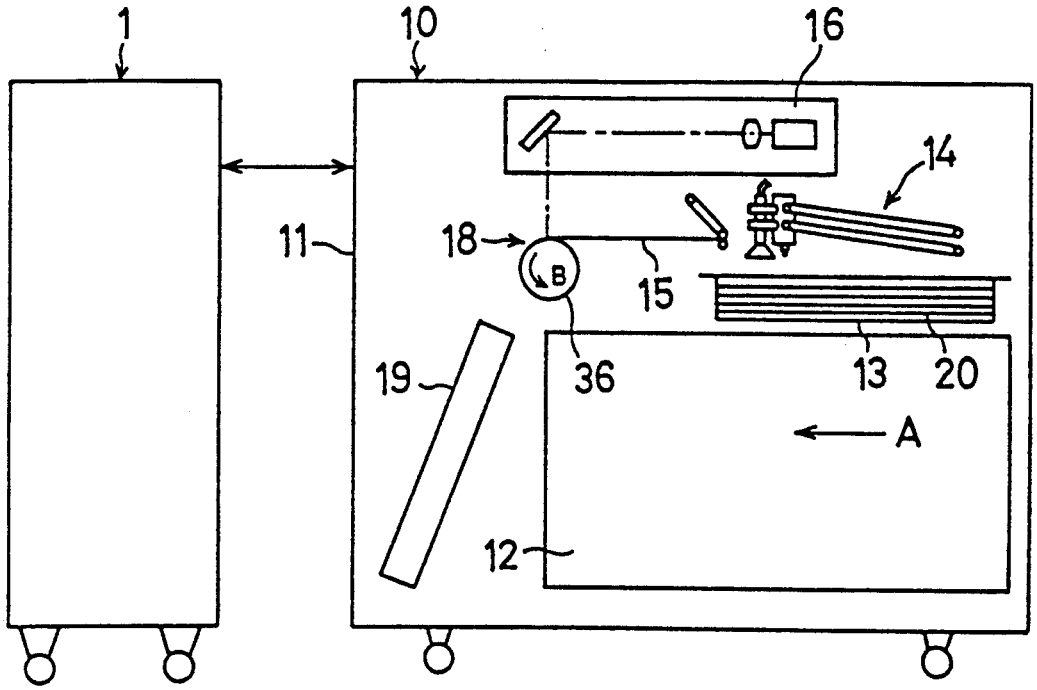
FIG. 1 is an illustration showing the general construction of a printing apparatus provided with the sheet feeding device of the present invention.

First, the printing apparatus provided with a sheet feeding device of the present invention is described hereinafter with reference to FIG. 1. The printer 10 has a container 11 which is sealed to prevent the entrance of light into the interior thereof, and is mainly provided with a box 12, sheet feeding device 14 including a magazine 13, sheet transporting section 15, optical unit 16, subscanning unit 18, and receiving magazine 19.

The magazine 13 can be loaded into and removed from the main housing, and accommodates in the interior thereof a plurality of stacked photosensitive sheets 20. The sheets 20 accommodated in the magazine 13 are picked up one sheet at a time by a vacuum type sheet feeding device 14 which transports the sheet 20 to the sheet transporting section 15 and to the sub-scanning unit 18. A sheet 20 in the sub-scanning unit 18 is transported in the direction of rotation B onto the sub-scanning drum 36, and is subjected to image exposure via a laser beam emitted from the optical unit 16, then is discharged into the receiving magazine 19. Item 1 in the drawing is a host computer which transmits image information to be printed to the printer 10. In the aforesaid construction, the exposed sheet 20 is removed from the apparatus together with the receiving magazine 19 and developed as necessary. The sheet 20 may be discharged from the apparatus after the developing process in the printer 10.

Figure 2:
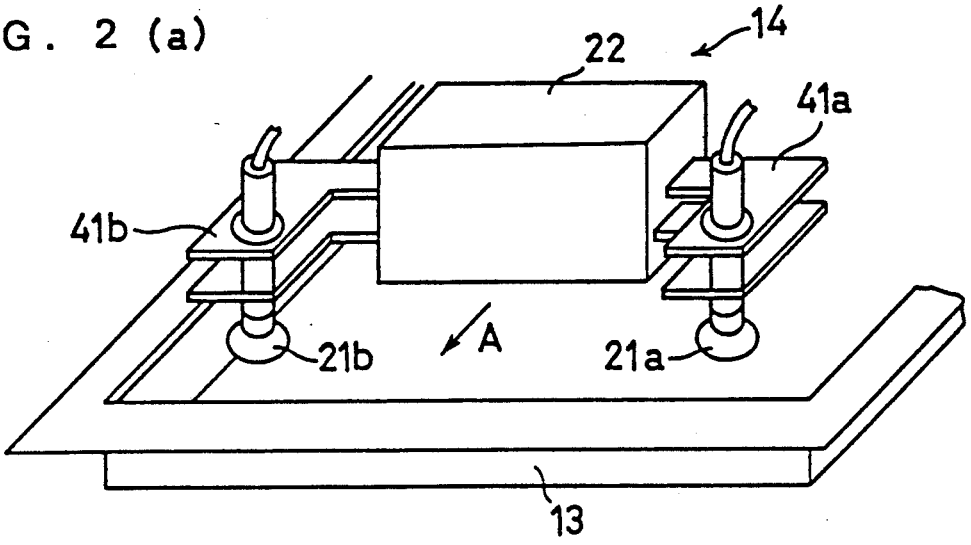
FIGS. 2*a* through 2*c* show the construction of the sheet feeding device of the present invention.
Figure 2:
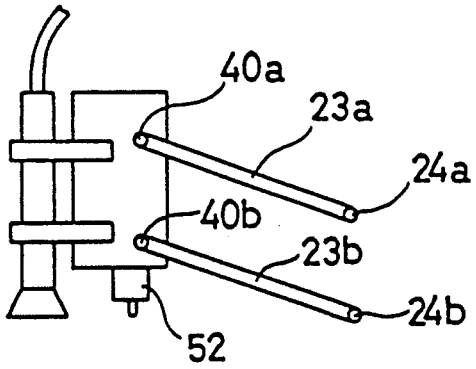
Figure 2:
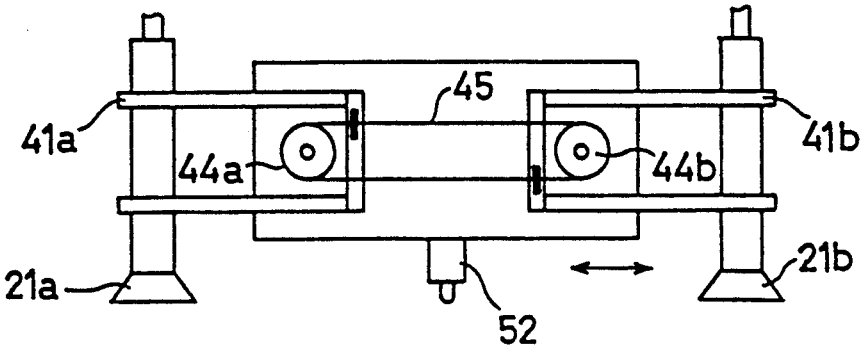

The construction and operation of the sheet feeding device 14 is described hereinafter with reference to FIG. 2. In the drawing, the arrow A indicates the sheet feeding direction. The sheet feeding device 14 has a pair of suction disks 21*a* and 21*b*. The suction disks 21*a* and 21*b* are mounted on frames 41*a* and 41*b* provided bilaterally in the suction disk holding unit 22 in a direction perpendicular to the sheet feeding direction A. The suction disks 21*a* and 21*b* are connected to a vacuum device (not shown in the drawings) by means of tubes. The vacuum device provides a suction on the sheet 20 when the suction disks 21*a* and 21*b* come into contact with the surface of the uppermost sheet 20.

On the other hand, the suction disk holding unit 22 is connected to arms 23*a* and 23*b* via shafts 40*a* and 40*b*. The arms 23*a* and 23*b* are connected to the respective shafts 24*a* and 24*b*, such that the suction disk holding unit 22 is vertically movable in one direction and an opposite direction by means of the shafts 24*a* and 24*b* which are rotated by a unit lifting motor (not illustrated). Inside the suction disk holding unit 22 is provided an adjustment mechanism to change the spacing between the suction disks 21*a* and 21*b* in accordance with the size of the sheet. More specifically, as shown in FIG. 2*c*, a belt 45 is reeved around the pulleys 44*a* and 44*b*, and fixed plates 41*a* and 41*b* thereto. The pulleys 44*a* and 44*b* can be forward and reverse rotated by means of a stepping motor (not illustrated), such that the spacing between the plates 41*a* and 41*b* can be narrowed or widened through the belt 45 so as to change the positions at which the suction disks 21*a* and 21*b* make contact with the sheet 20 in accordance with the sheet size. The bottom of the suction disk holding unit 22 is provided with a sensor 52 for detecting the presence of a sheet 20 within the magazine 13 so as to control the operation of the vacuum device, said sensor 52 being mounted at a height equal to the suction disks 21*a* and 21*b*.

Normally, the suction disk holding unit 22 is positioned above the magazine 13 at a sheet transporting position when the sheet feeding operation is not ongoing. When the sheet feeding operation starts, the spacing between the suction disks 21*a* and 21*b* is changed at the sheet feeding position as previously described in accordance with the size of the sheet used for printing, so as to determine a position at which the suction disks 21*a* and 21*b* make contact with the sheet 20. Then, the suction disk holding unit 22 is lowered, and stopped when the suction disks 21*a* and 21*b* make contact with the uppermost sheet 20. At this same time, the sensor 52 makes contact with the sheet 20 and is turned ON, thereby causing the vacuum device to operate and causing the sheet 20 to be suctioned by the suction disks 21*a* and 21*b*, while simultaneously the suction disk holding unit 22 is lifted, thereby picking up said sheet 20.

Figure 3:
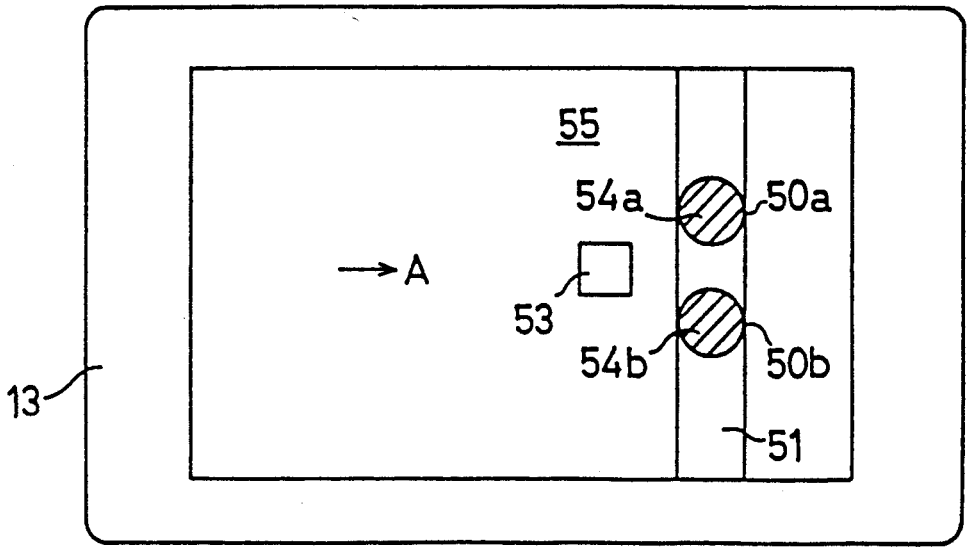
FIG. 3 shows the construction of the bottom surface of the magazine of a first embodiment of the present invention.

Details of the construction of the magazine 13 are described hereinafter in conjunction with FIG. 3. As shown in the drawing, concavities 50*a* and 50*b* are formed in the bottom surface of the magazine 13, and are of a size sufficient to allow the suction disks 21*a* and 21*b* to be accommodated therein. The cleaning members 54*a* and 54*b* are arranged in the concavities 50*a* and 50*b* such that their surfaces are lower than the bottom surface 55 of the magazine 13 so as not to make contact with the bottom surface of the sheet 20 deposited on the bottom surface 55. Various materials such as a sponge containing alcohol, adhesive tape with a suitable stickiness and the like may be used as the cleaning member. A concavity 53 is provided opposite the position of the aforesaid sensor 52 and is of a size sufficient only for the insertion of the operating element of the sensor 52. Item 51 in the drawing indicates the area wherein the suction disks are moved by the previously mentioned adjusting mechanism. In the present embodiment, the suction disks 21*a* and 21*b* are provided within the aforesaid area.

According to the aforesaid construction, when a sheet is not present in the magazine 13, the suction disks 21*a* and 21*b* come into contact with the cleaning member 54*a* and 54*b* and are cleaned thereby. The operation occurring at this time of said contact is described below.

Figure 4:
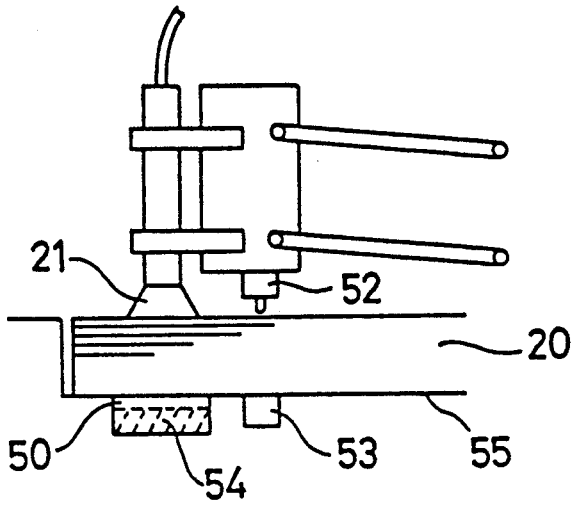
FIGS. 4*a* through 4*c* illustrate the sheet feeding operation and the cleaning operation of the first embodiment of the invention.
Figure 4:
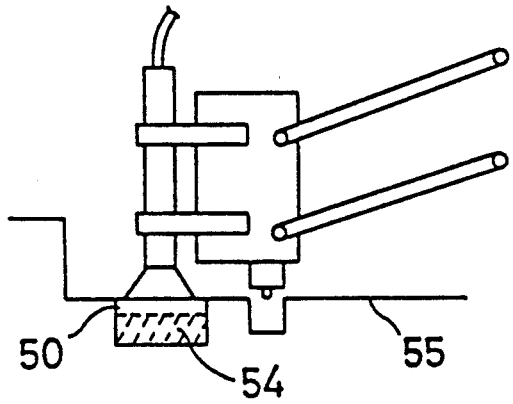
Figure 4:
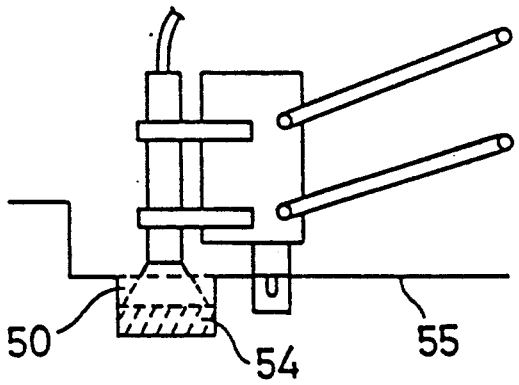

First, just as in the normal sheet feeding operation, after the spacing between the suction disks 21*a* and 21*b* is determined in accordance with the size of the sheet to be printed, the suction disk holding unit 22 is lowered. As previously described, if a sheet 20 is present in the magazine 13, the lowering of the suction disk holding unit 22 is stopped at the moment the suction disks 21*a* and 21*b* make contact with the sheet 20. However, when a sheet 20 is not present in the magazine 13, the lowering movement of the suction disk holding unit 22 is stopped at the moment the suction disks 21*a* and 21*b* make contact with the bottom surface 55 of the magazine 13. At this time, the sensor 52 for detecting the absence of sheet 20 is inserted into the concavity 53, as shown in FIG. 4*b*, so that the sensor 52 is not turned on and the vacuum device is not operated. Then, the suction disk holding unit 22 is directly lifted to the sheet feeding position. Thereafter, the spacing between the suction disks 21*a* and 21*b* is changed to correspond to the concavities 50*a* and 50*b* by the adjusting mechanism, then the suction disk holding unit 22 is again lowered to a position-at which the suction disks 21*a* and 21*b* make contact with the cleaning members 54*a* and 54*b*. At this time also, the sensor 52 is inserted into the concavity 53 and remains turned off so that the vacuum device is not operated. Then, the suction disks 21*a* and 21*b* are lifted to the sheet feeding position. Thus, the suction disks 21*a* and 21*b* are cleaned by means of contact with and separation from the cleaning members 54*a* and 54*b*.

Figure 5:
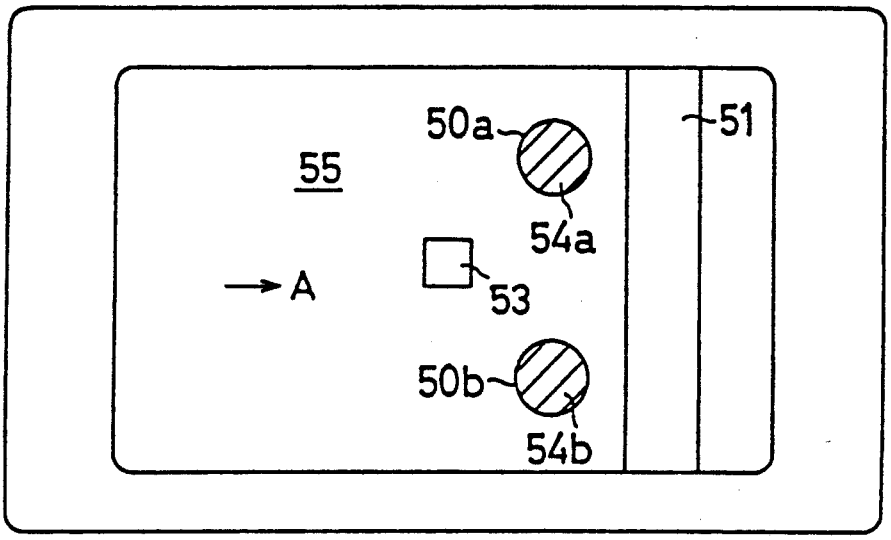
FIG. 5 shows a modification of the bottom surface of the magazine of the first embodiment.

In the embodiment described above, the positioning of the concavities is not limited to within the area 51 and, for example, may be shifted in a direction perpendicular to the sheet feeding direction A, as shown in FIG. 5. In this case, the suction disks 21*a* and 21*b* are also moved in the sheet feeding direction A during the cleaning operation.

Figure 6:
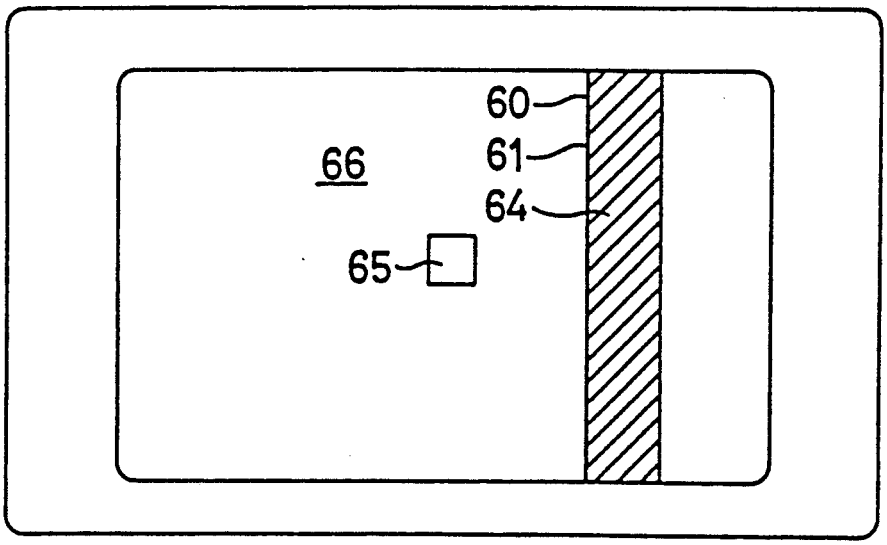
FIG. 6 shows the construction of the bottom surface of the magazine of a second embodiment of the present invention.
Figure 7:
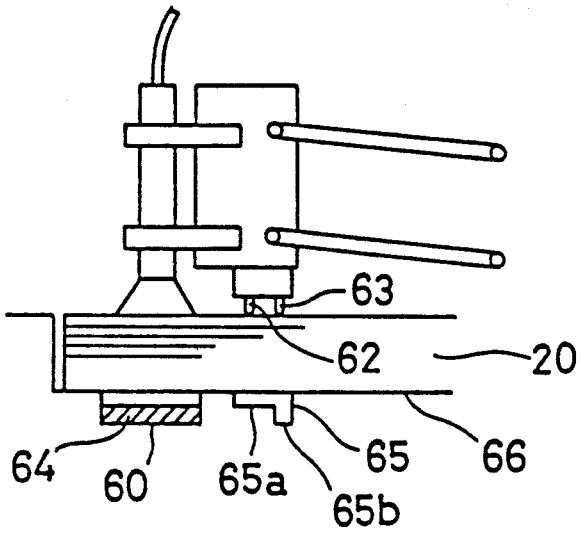
FIGS. 7*a* and 7*b* illustrate the sheet feeding operation and the cleaning operation of the suction disks of the second embodiment.
Figure 7:
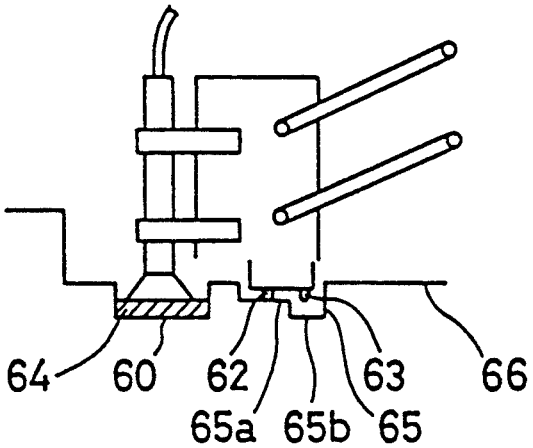

A second embodiment of the cleaning members for the suction disks 21a and 21b is described hereinafter with reference to FIGS. 6 and 7.

Two sensors 62 and 63 are mounted on the bottom surface of the suction disk holding unit 22 of the second embodiment, and are positioned at a height equal to the suction disks 21a and 21b. When the sensor 62 is turned ON, the lowering of the suction disk holding unit 22 is stopped. The sensor 63 detects the presence of a sheet 20 and controls the operation of the vacuum device by turning ON and OFF. In other respects the construction is identical to that of the first embodiment, and further description is therefore omitted herefrom.

On the other hand, a concavity 60 is provided on the bottom surface 66 of the magazine 13, and is positioned so as to be opposite the area of movement of the suction disks 21a and 21b accomplished via the previously mentioned adjusting mechanism. A cleaning member 64 is provided within the concavity 60. More specifically, the top surface of the cleaning member 64 is maintained so as to be lower than the bottom 66, such that the cleaning member 64 does not come into contact with the bottom of a sheet 20 disposed on the bottom surface 66 of the magazine 13. Furthermore, a first concavity 65a is provided on the bottom surface 66 of the magazine 13 and is positioned opposite the sensor 62 and has a height equal to the surface of the cleaning member 64, and a second concavity 65b is provided opposite the sensor 63 and has a depth deeper than the first concavity 65a.

When a sheet 20 is present in the magazine 13, the suction disk holding unit 22 is lowered and at the moment the sensor 62 is turned ON in conjunction with said lowering, the lowering movement stops, and the suction disks 21a and 21b are maintained in a state of contact with the with the sheet 20, as shown in FIG. 7a. At the same time, the sensor 63 also comes into contact with the sheet 20 and is turned ON, thereby operating the vacuum device and suctioning the sheet 20 via the suction disks 21a and 21b, and the suction disk holding unit 22 is again lifted so as to pick up the sheet 20. When a sheet 20 is not present in the magazine 13, on the other hand, the suction disk holding unit 22 is lowered for sheet feeding, the sensor 62 makes contact with the bottom surface of the concavity 65a and the lowering movement of the unit 22 is stopped at the moment of the aforesaid contact so that the suction disks 21a and 21b are maintained in a state of contact with the cleaning member 64, as shown in FIG. 7b. At this time, the sensor 63 does not make contact with the bottom of the concavity 65b and so remains turned OFF, and the vacuum device is not operated. Then, the suction disk holding unit 22 is again lifted to separate the suction disks 21a and 21b from the cleaning member 64, and the cleaning operated ends.

Thus, the cleaning member 64 is arranged at a position to generally correspond to the sheet contacting position of the suction disks 21a and 21b, so that even when the spacing of the suction disks 21a and 21b are changed in accordance with the size of the sheet 20, it is unnecessary to move said suction disks 21a and 21b before the cleaning operation. Furthermore, simultaneous empty detection and simultaneous cleaning are possible by providing two sensors.

Figure 8:
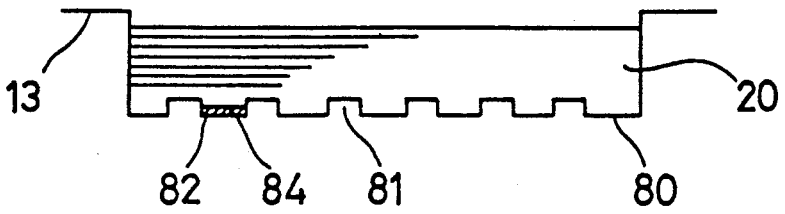
FIG. 8 shows another construction of the bottom surface of the magazine.

As shown in FIG. 8, concave-convexities may be provided on the entirety of the bottom surface 80 of the magazine 13, and the cleaning member 84 may be provided within a concavity 82 while the sheet 20 is supported by the convexities 81.

The above embodiment provides that if the magazine 13 is empty when the suction disk holding unit 22 is lowered, the suction disks 21 make contact with the cleaning member 54 or 64 so as to be cleaned thereby, and then the suction disk holding unit 22 is lifted. In order to reliably clean the suction disks 21, the suction disk holding unit 22 may be lowered and lifted several times so as to repeatedly make contact with the cleaning member 54 or 64. In such a case, the suction disk holding unit 22 may move reciprocally between the position whereat the suction disks 21 make contact with the cleaning member 54 or 64, and the position whereat the suction disks 21 are retracted from the cleaning member 54 or 64.

Figure 9:
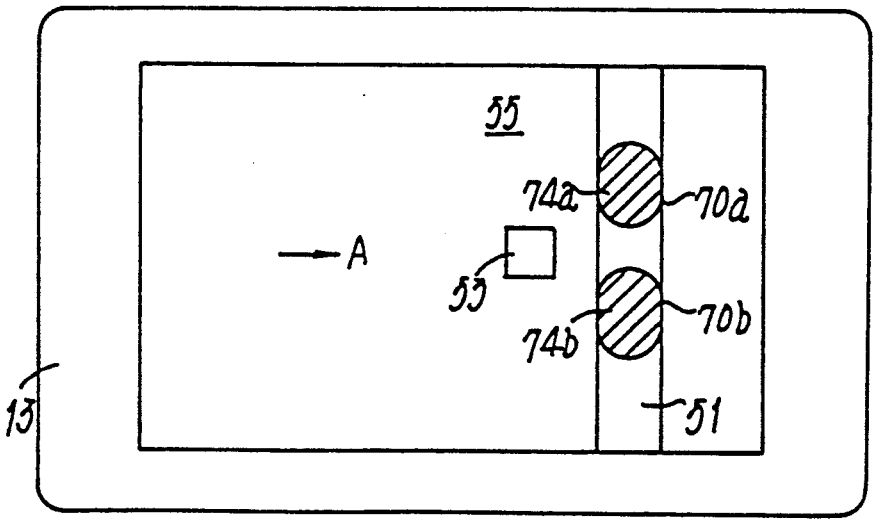
FIG. 9 is a plane view of another embodiment of the cleaning member.

Furthermore, the suction disks 21 and the cleaning members may rub one upon another to reliably clean the suction disks 21. FIG. 9 shows an example of cleaning members for the aforesaid purpose. That is, the cleaning members 74a and 74b may be elongated in a direction perpendicular to the sheet feeding direction A, in contrast to the substantially circular cleaning members 54a and 54b shown in FIG. 3. In this embodiment, the operation to the point at which the suction disk holding unit 22 is lowered until the suction disks 21a and 21b make contact with the cleaning members 74a and 74b is identical to the previous embodiment. In the present embodiment, when the suction disks 21a and 21b make contact with the cleaning members 74a and 74b, the adjusting mechanism is operated to adjust the spacing between the suction disks 21a and 21b, as shown in FIG. 2c, thereby reciprocally moving the suction disks 21a and 21b in a direction perpendicular to the sheet feeding direction A. Thus, the suction disks 21a and 21b rub against the cleaning members 74a and 74b, thereby being reliably cleaned. Furthermore, it is sufficient if the cleaning members have a length corresponding to the area of reciprocal movement of the suction disks 21a and 21b, but may also be disposed along the entire width of the magazine 13, as does the cleaning member 64 of FIG. 6. As previously described in connection to FIG. 5, if the device has a mechanism for moving the suction disks 21 in the sheet feeding direction A, the suction disks 21 may be rubbed against the cleaning member by moving the suction disks 21 in the sheet feeding direction A via said mechanism.

Figure 10:
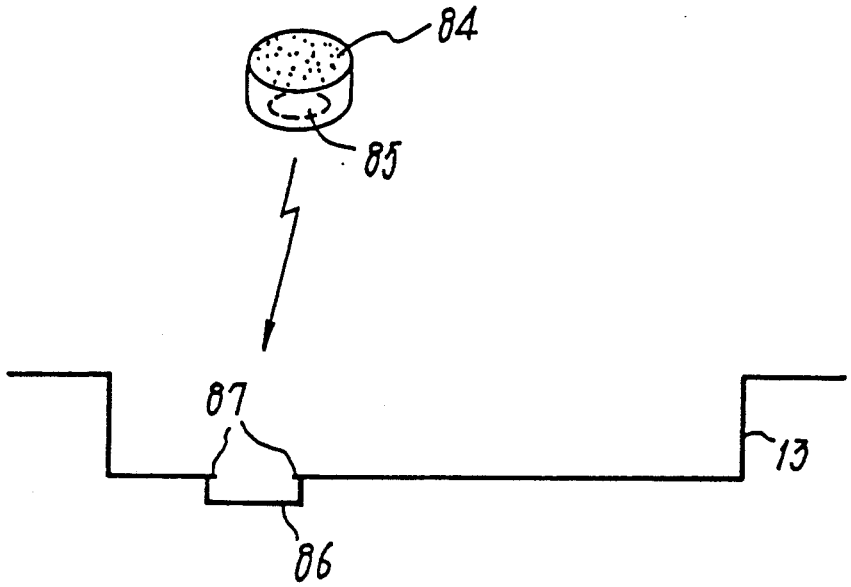
FIGS. 10*a* and 10*b* are section views showing another embodiment of the sheet accommodating portion.
Figure 10:
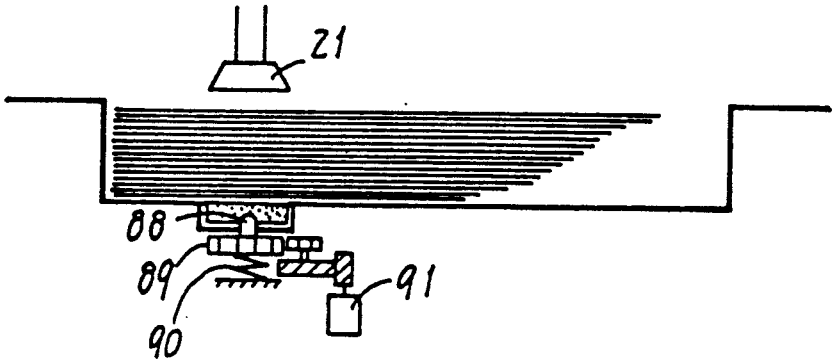

Although in the previously cited examples the rubbing of the suction disks 21 against the cleaning member is accomplished by moving the suction disks 21, it is to be noted that such rubbing may also be accomplished by moving the cleaning member. FIG. 10 shows an example of rubbing between the suction disk 21 and the cleaning member 84 via the movement of the cleaning member. The cleaning member 84 is a sponge containing alcohol, as in the prior embodiments, and also has a concavity 85 on the underside thereof. On the other hand, the concavity 86, which sets the cleaning member 84, is provide with a center hole opening on the bottom side thereof. A shaft 88 protrudes upward into the aforesaid hole to connect with the concavity 85 of the cleaning member 84. The bottom end of the shaft 88 has a gear 89 mounted thereto which is connected to and driven by a motor 91. The gear 89 is forced upwardly by means of a spring 90. Accordingly, when the cleaning member 84 is inserted into the concavity 86, the cleaning member 84 is forced upward by means of the gear 89 and the shaft 88. A hood-like hook member 87 is formed in the opening on the top end of the concavity 86, so as to prevent the cleaning member 84 from protruding from the concavity 86.

In the above embodiment, the operation is such that the suction disk moves downward until making contact with the cleaning member 84 in the same manner as in the previous embodiments. In the present embodiment, the timing for the contact of the suction disk 21 with the cleaning member 84 can be, for example, to start the drive of the motor 91 by the timing of turning on the sensor 62 of FIG. 7. When the motor 91 is actuated, the shaft 88 is rotated, and the cleaning member 84 is rotated in conjunction with the rotation of shaft 88. At this time, the cleaning member 84 is pressed against the suction disk 21 via the spring 90, and is rotated while in said state. Thus, the suction disk 21 rubs against the cleaning member 84 and is reliably cleaned thereby.

Figure 11:
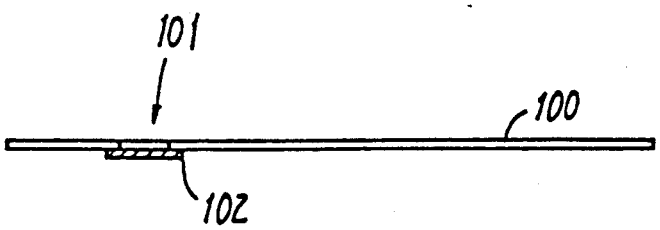
FIGS. 11*a* through 11*c* are section views showing still another embodiment of the sheet accommodating portion
Figure 11:
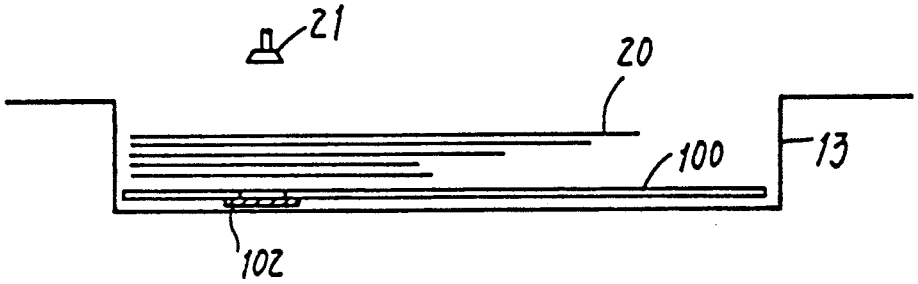
Figure 11:
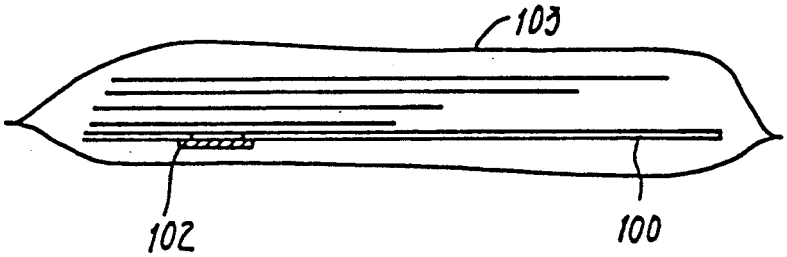

The mechanism for cleaning the suction disk 21 with the cleaning member is described hereinafter with reference to FIG. 10 and 11. When the cleaning operation with the cleaning member is repeated, the cleaning member gradually becomes soiled. Accordingly, the cleaning member must be periodically replaced. When the magazine 13 is of a disposable magazine type, the cleaning member need not be replaced individually, since is disposed of together with the magazine 13 before it is fully soiled. The cleaning member must be replaced, however, when the magazine 13 is permanently provided in a sheet feeding device, or is removably loaded in such a device and is of a reusable type which can be refilled with sheets.

FIGS. 11*a* and 11*b* show an example of a magazine allowing easy replacement of the cleaning member. In the drawing, item 100 is a support plate for supporting the sheets 20, and is a thick paper sheet having a configuration identical to that of the bottom surface of the magazine 13. This support plate 100 is dropped into the magazine 13 and supports the a stack of sheets 20 on the top surface thereof. That is, the support plate 100 becomes the bottom surface of the container portion for accommodating the sheets 20. The support plate 100 is also provided with holes 101 of a size only sufficient to accommodate the suction disk 21, the bottom side of said holes 101 being sealed by adhesive tape 102. In the present embodiment, the operation for cleaning the suction disks 21 is identical to that of the first embodiment. That is, the suction disk 21 enters the hole 101 and is cleaned via contact with the adhesive tape 102. On the other hand, the sheet 20 supported on the support plate 100 does not come into contact with the adhesive tape 102. According to the present embodiment, the replacement of the adhesive tape which is in fact the cleaning member, is easily accomplished by replacing the supporting plate 100. The easy replacement of the cleaning member may also be accomplished by having a support plate 100 which supports the replacement sheets 20 sealed in a packing material containing the sheets 20 so as to be used for replenishing the magazine 13, as shown in FIG. 11*c*. In such a case, when the sheets 20 are replenished in the magazine 13, the cleaning member is replaced by simply removing the packaging material 103 and setting the sheets 20 and support plate 100 together in the magazine 13, thereby eliminating any user anxiety about replacing the cleaning member. In the present embodiment, the cleaning member is not limited to adhesive tape, but may also be a sponge and the like mounted on the support plate 100 by means of an adhesive material.

Figure 12:
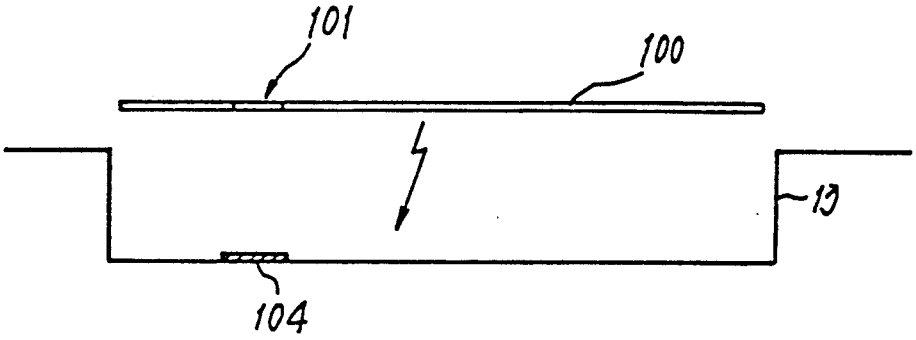
FIG. 12 is a section view showing another embodiment of the sheet accommodating portion.

In the present embodiment, the bottom surface of the magazine 13 has been described as a flat surface without a downward projection so make the magazine stable when placed on a table outside the apparatus as a supplementary magazine. Furthermore, because the top surface of the base of the magazine is flat, the cleaning member does not adhere to the support plate and the cleaning member is easily replaceable. That is, the cleaning member 104 shown in FIG. 12 is alone disposed on the bottom surface of the magazine 13, and the support plate 100 is superimposed thereon. In this embodiment, when the cleaning member 104 is replaced, the support plate 100 is removed from the magazine 13. In this state, the user can easily remove the cleaning member 104 because the cleaning member 104 is only put on the bottom surface of the magazine 13. Then, a new cleaning member can be installed on the bottom surface of the magazine 13, and when the support plate 100 is dropped in place on top of the cleaning member the replacement operation is completed.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sheet feeding device comprising:

sheet accommodating means for accommodating sheets;

suction means for suctioning sheets accommodated by said sheet accommodating means so as to pick up and transport the sheets through vertical movement thereof;

opening portion formed on said sheet accommodating means; and cleaning means arranged under said opening portion for cleaning said suction means after the sheets accommodated by said sheet accommodating means are run out.

2. The sheet feeding device as claimed in claim 1, wherein the surface of said cleaning means is lower than the bottom of the sheet accommodating means.

3. The sheet feeding device as claimed in claim 1, wherein said sheet accommodating means includes a supporting plate set on the bottom thereof for supporting the accommodated sheets, and said opening portion is provided on the supporting plate.

4. The sheet feeding device as claimed in claim 1 further comprising a sensor for detecting the presence of sheets in said sheet accommodating means.

5. The sheet feeding device as claimed in claim 1, wherein said suctioning means includes vertically movable suction disks, and said suction disks are inserted into and retracted from said opening portion so as to be cleaned by said cleaning member.

6. The sheet feeding device as claimed in claim 5 further comprising concave portion formed on the bottom of said sheet accommodating means and under said opening portion, wherein said cleaning member is arranged within said concave portion.

7. The sheet feeding device as claimed in claim 6, wherein said cleaning member is movable by driving means for cleaning the said suction disks.

8. The sheet feeding device as claimed in claim 5 further comprising adjusting means for adjusting the distance between said disks in a direction perpendicular to sheet feeding direction in accordance with the size of sheets accommodated by said sheet accommodating means.

9. The sheet feeding device as claimed in claim 8, wherein said suction disks are reciprocated by said adjusting means in being cleaned by said cleaning member.

10. The sheet feeding device as claimed in claim 8, wherein said opening portion and said cleaning member are provided in a position opposite to a range in which the suction disks is movable by said adjusting means.

11. The sheet feeding device as claimed in claim 8, wherein said cleaning member is provided in a whole range in a direction perpendicular to sheet feeding direction and opposite to the suction disks.

12. The sheet feeding device as claimed in claim 8, wherein said-adjusting means adjusts the position of suction disks in the sheet feeding direction, and said cleaning member is provided outside a position opposite to the suction disks in a direction perpendicular to the sheet feeding direction.

13. The sheet feeding device as claimed in claim 1, wherein said cleaning member is adhesive tape.

14. The sheet feeding device as claimed in claim 1, wherein said cleaning member is a sponge containing alcohol.

15. A sheet feeding device comprising:

sheet accommodating means for accommodating sheets;

movable suction disks for suctioning the sheets accommodated by said sheet accommodating means so as to pick up and transport the sheets;

concave portion formed on the bottom of said sheet accommodating means such that said suction disks are inserted to and retracted from said concave portion; and cleaning member for cleaning said suction disks, said cleaning member being arranged within said concave portion such that the surface thereof is lower than the bottom of the sheet accommodating means.

16. The sheet feeding device as claimed in claim 15 further comprising adjusting means for adjusting position of said suction disks in a direction perpendicular to sheet feeding direction.

17. The sheet feeding device as claimed in claim 16, wherein said adjusting means adjusts the position of said suction disks in the sheet feeding direction.

18. The sheet feeding device as claimed in claim 15 further comprising a sensor for detecting the presence of sheets in said sheet accommodating means so as to clean said suction disks when no sheet is present in said sheet accommodating means.

19. A method for cleaning suction disks provided in a sheet feeding device so as to pick up and transport sheets accommodated in sheet accommodating means, comprising following steps of:

descending said suction disks till contacting with the top surface of the sheets accommodated by said sheet accommodating means;

determining whether or not any sheets are present in the sheet accommodating means;

descending again said suction disks, when no sheet is present in the sheet accommodating means, till contacting with a cleaning member which is disposed at a position lower than the bottom of said sheet accommodating means; and cleaning said suction disks by said cleaning member.

* * * * *

UNITED STATES PATENT AND TRADEMARK OFFICE

CERTIFICATE OF CORRECTION

PATENT NO. : 5,284,334

DATED : February 8, 1994

INVENTOR(S) : Junichi Yamamoto

It is certified that error appears in the above-indentified patent and that said Letters Patent is hereby corrected as shown below:

On title page, item [75] change the spelling of the first name of the inventor from "Junich" to --Junichi--.

In Col. 5, line 67, change "concave-convexities" to --concavo-convexities--.

In Col. 9, line 19 (Claim 12, line 2), delete "-" (hyphen) between "said" and "adjusting."

Signed and Sealed this

Fourteenth Day of June, 1994

Bruce Lehman

*Attest:*

BRUCE LEHMAN

*Attesting Officer*

*Commissioner of Patents and Trademarks*